US005904110A

United States Patent [19]

Kwang

[11] Patent Number: 5,904,110

[45] Date of Patent: May 18, 1999

[54] UNDER THREAD BOBBIN EXCHANGE DEVICE OF AN EMBROIDERY OR SEWING MACHINE

[75] Inventor: Ricky Pang Kim Kwang, Singapore, Singapore

[73] Assignee: Madeira Asia Pte. Ltd., Singapore, Singapore

[21] Appl. No.: 08/964,563

[22] Filed: Nov. 5, 1997

[30] Foreign Application Priority Data

Nov. 7, 1996 [DE] Germany ..... 196 45 979

[51] Int. Cl.[6] ..... D05B 59/04

[52] U.S. Cl. ..... 112/186

[58] Field of Search ..... 112/180, 279, 112/231, 302, 186

[56] References Cited

U.S. PATENT DOCUMENTS

| | | | |
|---|---|---|---|
| 862,033 | 7/1907 | Toof | 112/186 X |
| 3,744,442 | 7/1973 | Michaels et al. | 112/186 |
| 3,747,547 | 7/1973 | Mayer et al. | 112/186 |
| 3,981,256 | 9/1976 | Sexton | 112/180 |
| 5,143,004 | 9/1992 | Mardix et al. | 112/186 |

FOREIGN PATENT DOCUMENTS

| | | | |
|---|---|---|---|
| 4002395 | 1/1992 | Japan | 112/186 |
| 4073094 | 3/1992 | Japan | 112/279 |

*Primary Examiner*—Ismael Izaguirre
*Attorney, Agent, or Firm*—Henry M. Feiereisen

[57] ABSTRACT

An under thread bobbin exchange device for an industrial embroidery machine or sewing machine of a type having a hook shaft adapted for driving a shuttle, includes a carriage having at least two coupling shafts in parallel disposition to the hook shaft, each of said coupling shafts having a hook shaft distal end and a hook shaft proximal end, with the hook shaft proximal end capable of being coupled to the hook shaft such that the carriage is positioned at a right angle to the hook shaft when the hook shaft is at a standstill and capable to reciprocate in parallel disposition to a throat plate plane by the distance of the coupling shafts, and with each one of the hook shaft distal ends carrying a shuttle.

14 Claims, 3 Drawing Sheets

UNDER THREAD BOBBIN EXCHANGE DEVICE OF AN EMBROIDERY OR SEWING MACHINE

BACKGROUND OF THE INVENTION

The present invention refers to a device for changing the under thread bobbin of an industrial embroidery or sewing machine of a type having a shuttle driven by a hook shaft.

In general, an embroidery or sewing machine requires a removal of an under thread bobbin from the shuttle for replacement by a new bobbin when the under thread is spent and thus the bobbin is empty or when the under thread ruptures during stitching operation. Replacement or exchange of the bobbin can only be carried out in idle state of the machine. Typically, the shutdown of the machine is effected automatically and is triggered by an under thread guard or detector. When the machine spins at a normal speed of 700 rpm and when using a standard under thread bobbin of approximately 100 m thread length, the under thread is usually used up already after about 45 minutes.

Even though, a needed replacement of a spent under thread bobbin during shutdown of the machine can be executed by skilled personnel in about five to eight seconds, these shutdown periods have a significant impact on industrial embroidery or sewing machines because these types of stitching machines have normally 10 to 20 stitching heads operating at a same time. Thus, when the under thread is used up on the bobbin of one stitching head, operation of all stitching heads must be shutdown. This means, for example in a stitching machine with twenty heads, a loss of three minutes is to be accepted in production time per work hour during periodic change of all under thread bobbins.

SUMMARY OF THE INVENTION

It is thus an object of the present invention to provide an improved under thread bobbin exchange device, obviating the afore-stated drawbacks.

In particular, it is an object of the present invention to provide an improved under thread bobbin exchange device which is capable of significantly reducing the shutdown periods and resulting production loss of an embroidery or sewing machine as a consequence of spent or ruptured under threads.

These objects and others which will become apparent hereinafter are attained in accordance with the present invention by providing a carriage having at least two coupling shafts in parallel disposition to the hook shaft, with each coupling shaft having a hook shaft distal end carrying a shuttle that accommodates an under thread bobbin, and a hook shaft proximal end which is so coupled to the hook shaft that the carriage is positioned at a right angle to the hook shaft when the hook shaft is at a standstill and is capable to reciprocate in parallel disposition to a throat plate plane by the distance of the coupling shafts.

Through provision of an under thread bobbin exchange device according to the present invention, at least two shuttles are assigned to the stitching head or sewing head or each stitching head, with each shuttle containing a bobbin which has a full supply of under thread at commencement of production. While one of the two shuttles is idle and occupies a holding position, the other shuttle is in the operative position to feed in a conventional manner the under thread for the stitching operation. In the event an under thread wound on a bobbin is used up in one of the shuttles or a rupture of an under thread is encountered, the stitching machine is shutdown. Conventionally, the bobbin, together with the bobbin case, is taken out manually of the shuttle, and after wound by another under thread, the bobbin is returned to the shuttle. This manual procedure can now be avoided by simply shifting the carriage to the opposite end position to enable the other shuttle to move to its operative position. This exchange process takes less than one second for each head. Subsequently, the machine can immediately be operated again. While the machine is running, the empty bobbin of the shuttle now in holding position can be replaced by a full bobbin without time constraints. This exchange operation repeats each time an under thread bobbin is spent.

In conventional multi-head embroidery machines in which all heads normally stitch a same pattern, it is advantageous to simultaneously replace the under thread bobbins of all heads as soon as the under thread bobbin of one head is used up. Although, this procedure results in a shutdown of the machine, it is still more economical to restart the entire machine after about one second with fully loaded bobbins than to use up the normally small leftover thread on each bobbin and to accept shutdown periods of the machine in accordance with the number of heads.

According to another feature of the present invention, the hook shaft has a head formed with a transverse slot which extends parallel to a direction of movement of the carriage when the hook shaft is at a standstill, with each of the coupling shafts having an engagement member formed with a wedge for engagement in the transverse slot. This configuration exploits the fact that industrial embroidery and sewing machines and thus hook shafts occupy precisely defined positions at standstill.

Suitably, the transverse slot and/or wedges are formed with slanted ramp surfaces to enable a secure engagement of the respective coupling shaft with the driven hook shaft even when the clearance between the transverse slot at the end of the hook shaft and the wedges of the respective coupling shafts is narrow.

As the position of the hook shaft during shutdown of the machine is precisely defined, there is a risk that the coupling shaft of the shuttle in holding position, e.g. during replacement of the under thread bobbin, unintentionally pivots out from its required position for effecting the engagement. It is thus suitable to provide the coupling shafts with a safety mechanism that prevents a rotation of the coupling shafts. In accordance with a preferred embodiment of the present invention, a safety mechanism is proposed which includes a member that forms a track extending in parallel disposition to the direction of movement of the carriage and in alignment with the wedges.

A precise guidance of the carriage during reciprocating movement between the end positions for linking the coupling shaft of one or the other shuttle to the hook shaft can be effected in many ways that are available to a person skilled in the art. Preferably, the carriage is guided on a prismatic rail. Normally, the carriage is displaced by means of an electromotoric drive, such as rotating or linear standardized drives, suitably combined with an incremental displacement pick-up to ensure that the carriage precisely stops in the preset position in which the coupling shaft of the active shuttle is accurately aligned with the hook shaft. Tests have shown that the use of simple limit switches effects an accurate positioning of the carriage.

Suitably, the electromotoric drive of the carriage is so operatively connected with a control system of the stitching machine that activation of the drive occurs only when the hook shaft stands still. In conjunction with multi-head machines, it is preferred to configure the control system in such a manner that a shutdown of the machine as a result of spent under thread on one head triggers activation of the carriage drive of only the head assigned thereto or activation of all carriage drives at a same time.

It is also possible to activate the electromotoric drive of the carriage by the electric machine control system in combination with an under thread guard associated to each embroidery or sewing head.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
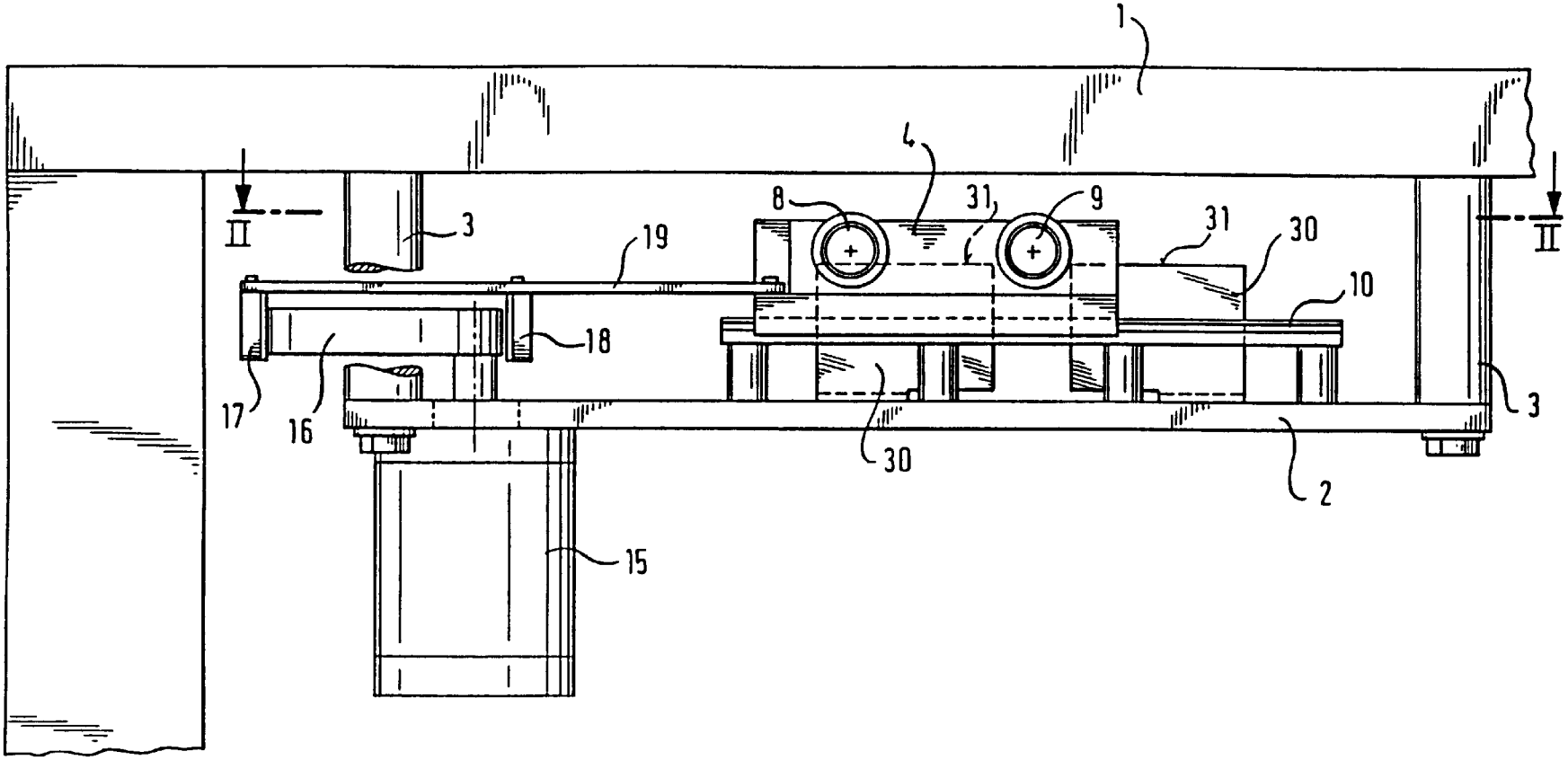
FIG. 1 is a schematic, fragmentary front view of one embodiment of an embroidery machine, equipped with an under thread bobbin exchange device.

Throughout all the Figures, the same or corresponding elements are generally indicated by the same reference numerals.

Turning now to the drawing, and in particular to FIG. 1, there is shown a schematic, fragmentary front view of one embodiment of a typical stitching machine, equipped with an under thread bobbin exchange device situated underneath a throat plate I which is only depicted schematically and is part of the stitching machine. The bobbin exchange device includes a base plate 2 which is suspended by columns 3 from the throat plate 1, thus allowing a retrofitting of existing stitching machines with the bobbin exchange device according to the present invention.

Figure 2:
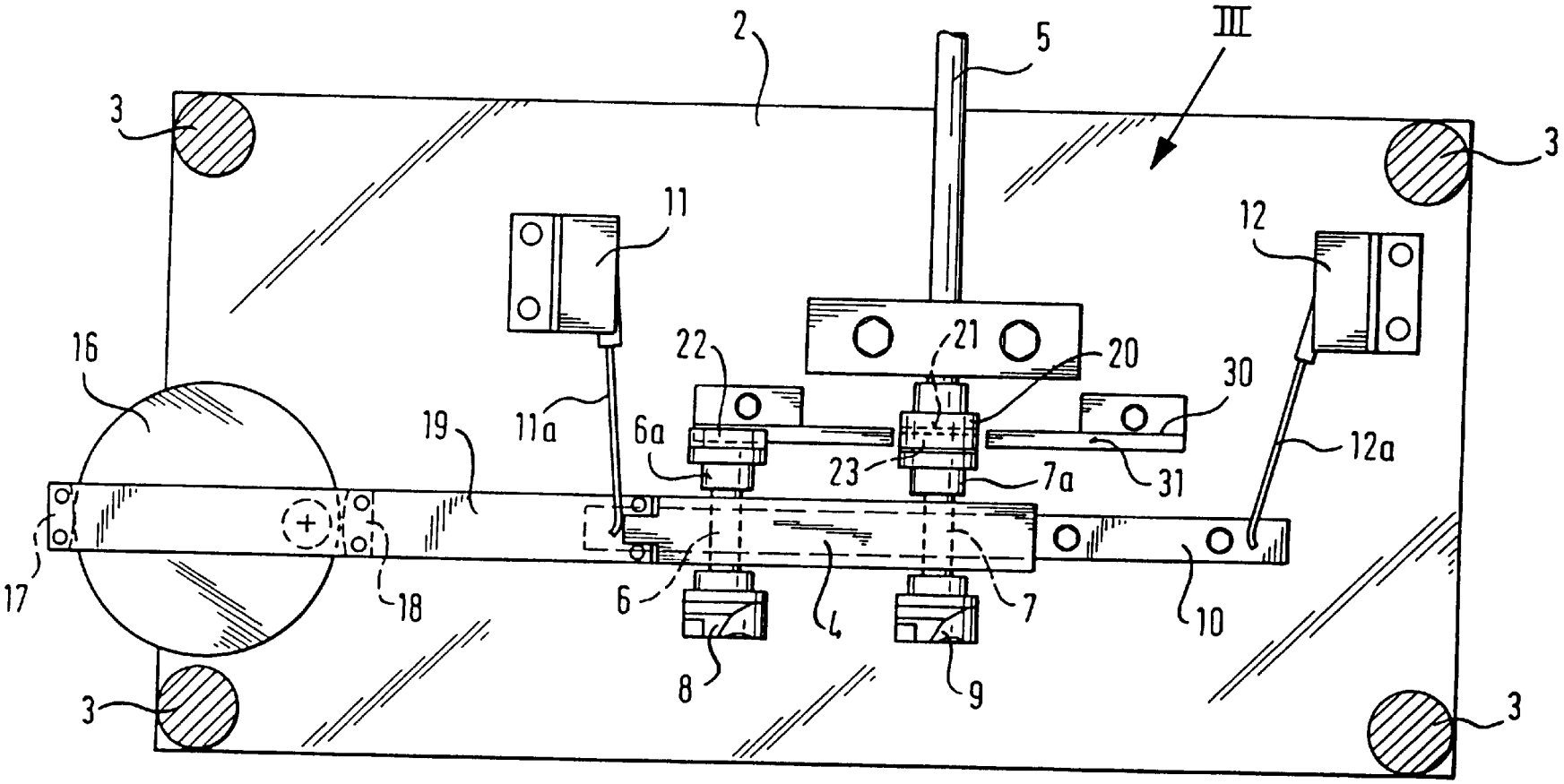
FIG. 2 is a plan view of the under thread bobbin exchange device in direction of arrow II—II in FIG. 1.

As shown in conjunction with FIG. 2, a hook shaft 5 is disposed right under the throat plate 1 of the embroidery machine for interaction with the bobbin exchange device which generally includes a carriage 4 supporting two coupling shafts 6, 7 in parallel disposition to the shaft 5. With their end distal to the hook shaft 5, each of the coupling shafts 6, 7 supports a shuttle (or looptaker) 8, 9 for accommodating a bobbin which is wound with an under thread. The carriage 2 is guided on a prismatic guide rail 10 for displacement between two end positions in a direction perpendicular to the shaft 5 by the distance between the coupling shafts 6, 7. The end positions of the carriage 4 are determined by two microswitches 11, 12, such as limit switches, which are shown schematically only. Each of the microswitches 11, 12 carries a touching lever 11*a*, 12*a* which is acted upon by the respective end face of the carriage 4.

The displacement of the carriage 4 between both end positions is effected by an electromotoric drive, symbolized in FIG. 1 by an electromotor 15 which rotates via a gear mechanism an eccentric disk 16 between two spaced-apart cams 17, 18. One end of the cams 17, 18 is fixed to an arm 19 which has a cam-distant end secured to the carriage 4.

Figure 3:
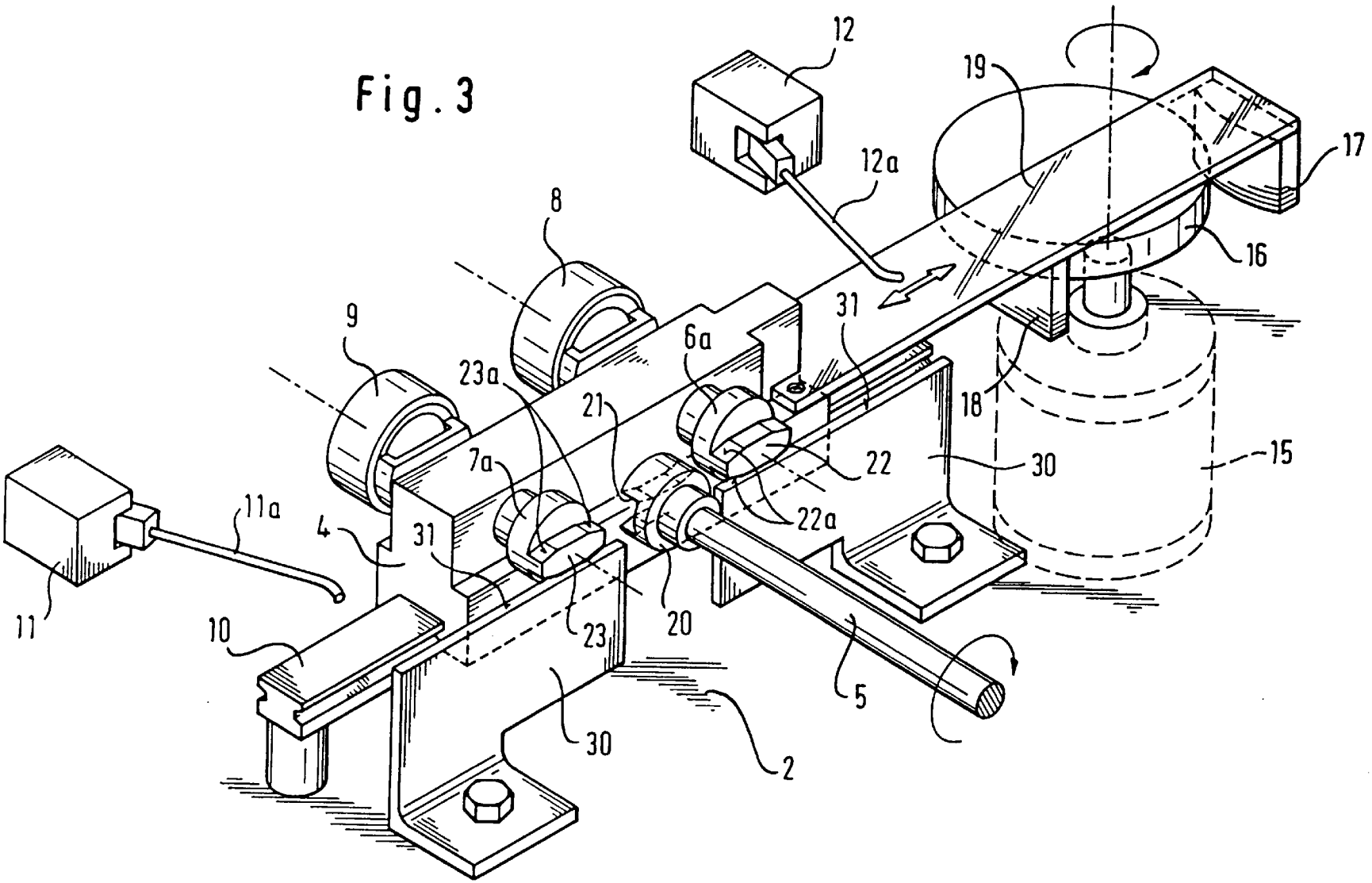
FIG. 3 is a perspective illustration of the under thread bobbin exchange device, as viewed in direction of arrow III in FIG. 1.

FIG. 2 depicts the carriage 4 in its left end position, with the right shuttle 9 occupying its operative position in which the coupling shaft 7 of the shuttle 9 is linked to the shaft 5. FIG. 3 illustrates an intermediate position of the carriage 4 between the end positions.

In order to permit a selective connection of the shaft 5 with one or the other one of coupling shafts 6, 7 of the shuttles 8, 9, the shaft 5 is provided on one end with a head 20 which is formed with a transverse slot 21, as best seen in FIG. 3. The transverse slot 21 is disposed in horizontal alignment when the shaft 5 is at a standstill. Each one of the coupling shafts 6, 7 is formed with an engagement member 6*a*, 7*a* which is formed with a wedge 22, 23 for engagement in the transverse slot 21 of the shaft 5. The wedges 22, 23 are each suitably formed with a slanted ramp surface 22*a*, 23*a* to facilitate entry of the wedges 22, 23 into the transverse slot 21.

In order to ensure a horizontal disposition of the wedges 22, 23 after disengagement from the slot 5 for a subsequent re-entry, rails 30 are secured to the base plate 2 on either side of the shaft 5 in immediate proximity thereto. Each rail has an upper edge which forms a track 31 which is in alignment with the wedges 22, 23. Thus, upon exiting the slot 21 of the shaft 5, the wedges 22, 23 run on the track 31 so as to be prevented from executing a rotational movement.

Persons skilled in the art will understand that a reverse configuration of slot and wedges is certainly possible and within the scope of the present invention, i.e. to provide the hook shaft with a wedge for interaction with a slot formed on each coupling shaft. The configuration as described in FIGS. 1 to 3 is however a preferred embodiment because it simplifies the incorporation of a safety mechanism to prevent rotation of the coupling shafts through provision of the track 31 parallel to the carriage 4 and in alignment with the wedges 22, 23.

While the invention has been illustrated and described as embodied in an under thread bobbin exchange device of an embroidery or sewing machine, it is not intended to be limited to the details shown since various modifications and structural changes may be made without departing in any way from the spirit of the present invention.

What is claimed as new and desired to be protected by Letters Patent is set forth in the appended claims:

1. An under thread bobbin exchange device for a machine which is selected from the group consisting of stitching machine, embroidery machine and sewing machine and has a hook shaft adapted for driving a shuttle, said under thread bobbin exchange device comprising:

a carriage having at least two coupling shafts in parallel disposition to the hook shaft, each of said coupling shafts being movable between an idle position and an operative position and having a first end which confronts the hook shaft and is formed with a wedge and having a second end distant to the hook shaft, said first end capable of being coupled to the hook shaft in the operative position, said carriage, when the hook shaft is at a standstill, being capable to reciprocate by the distance of the coupling shafts at a right angle to the hook shaft and in parallel disposition to a throat plate plane;

a first shuttle secured to the second end of one of the coupling shafts;

a second shuttle secured to the second end of the other one of the coupling shafts; and a mechanism for preventing a rotation of the coupling shafts when being disengaged from the hook shaft, said mechanism including a member forming a track extending in parallel disposition to the direction of movement of the carriage, said wedges sliding on the track when moving the coupling shafts to and from the operative position.

2. The device of claim 1 wherein the hook shaft has a head formed with a transverse slot which extends parallel to a direction of movement of the carriage and in alignment with the track when the hook shaft is at a standstill, said transverse slot being engageable by the wedges of said coupling shafts.

3. The device of claim 2 wherein at least one of the elements selected from the group consisting of transverse slot and wedge is formed with a slanted ramp surface.

4. The device of claim 1, and further comprising a prismatic rail for guiding the carriage in the direction of movement.

5. The device of claim 1, and further comprising an electromotoric drive for effecting a displacement of the carriage in the direction of movement.

6. The device of claim 5 wherein the electromotoric drive is activated when the hook shaft is at a standstill.

7. The device of claim 5 wherein the electromotoric drive is activated by a thread guard.

8. A stitching machine; comprising:

a first shaft;

a shuttle arrangement for interaction with the first shaft, said shuttle arrangement including a carriage movable between two end positions, and at least two coupling shafts received in the carriage in parallel disposition to the first shaft and carrying a shuttle containing a bobbin with an under thread, each of said coupling shafts having one end which confronts the first shaft and is formed with a wedge, said coupling shafts being so operated by the carriage that in one end position of the carriage the wedge of one of the coupling shafts is in interlocking engagement with the first shaft and in the other end position the wedge of the other one of the coupling shafts is in interlocking engagement with the first shaft; and a mechanism for preventing a rotation of the coupling shafts when being disengaged from the first shaft, said mechanism including a member forming a track extending in parallel disposition to the direction of movement of the carriage, said wedges sliding on the track when moving the coupling shafts to and from the end positions of the carriage.

9. The machine of claim 8 wherein the first shaft has a head formed with a transverse slot which extends parallel to a direction of movement of the carriage and in alignment with the track when the first shaft is at a standstill, said transverse slot being engageable by the wedges of said coupling shafts.

10. The machine of claim 9 wherein at least one of the elements selected from the group consisting of transverse slot and wedge is formed with a slanted ramp surface.

11. The machine of claim 8, and further comprising a prismatic rail for guiding the carriage in the direction of movement.

12. The machine of claim 8, and further comprising an electromotoric drive for effecting a displacement of the carriage in the direction of movement.

13. The machine of claim 12 wherein the electromotoric drive is activated when the first shaft is at a standstill.

14. The machine of claim 12 wherein the electromotoric drive is activated by a thread guard.

* * * * *